US009163470B2

(12) United States Patent
Gambier et al.

(10) Patent No.: US 9,163,470 B2
(45) Date of Patent: Oct. 20, 2015

(54) MULTIPLE ACTIVATION-DEVICE LAUNCHER FOR A CEMENTING HEAD

(75) Inventors: Philippe Gambier, La Defense (FR); Greg Giem, Houston, TX (US); Joel Rondeau, Antony (FR); Chris Fitzgerald, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 587 days.

(21) Appl. No.: 13/121,487

(22) PCT Filed: Sep. 16, 2009

(86) PCT No.: PCT/EP2009/006748

§ 371 (c)(1),
(2), (4) Date: Jun. 28, 2011

(87) PCT Pub. No.: WO2010/040445

PCT Pub. Date: Apr. 15, 2010

(65) Prior Publication Data

US 2011/0247834 A1 Oct. 13, 2011

Related U.S. Application Data

(60) Provisional application No. 61/195,499, filed on Oct. 7, 2008.

(51) Int. Cl.
*E21B 33/05* (2006.01)
*E21B 33/068* (2006.01)

(52) U.S. Cl.
CPC ..... *E21B 33/05* (2013.01); *E21B 33/068* (2013.01)

(58) Field of Classification Search
CPC ..... E21B 33/13; E21B 33/14; E21B 33/16
See application file for complete search history.

(56) References Cited

U.S. PATENT DOCUMENTS 3,039,531 A 6/1962 Scott
3,322,197 A 5/1967 Baker et al.

(Continued)

FOREIGN PATENT DOCUMENTS

EP 0801704 B1 2/2003
EP 1540131 A2 6/2005

(Continued)

OTHER PUBLICATIONS

Leugemors E, Metson J, Pessin J-L, Colvard RL, Krauss CD and Plante M: "Cementing Equipment and Casing Hardware," in Nelson EB and Guillot D (eds.): Well Cementing—2nd Edition, Houston: Schlumberger (2006): 343-434.

(Continued)

*Primary Examiner* — Jennifer H Gay
*Assistant Examiner* — Caroline Butcher
(74) *Attorney, Agent, or Firm* — Michael Dae; Rachel Greene; Tim Curington

(57) ABSTRACT

A multiple activation-device launching system for a cementing head comprises a launcher body comprising at least one launching chamber and a device chamber, the launching chamber sized to receive one or more activation devices therein, the launching chamber in fluid communication with a power source for launching the activation device into the device chamber. The launching system may further comprise a pressure sensor, a pressure-relief device or a flow-measurement device, or combinations thereof.

16 Claims, 9 Drawing Sheets

(56) References Cited

U.S. PATENT DOCUMENTS

| | | | | |
|---|---|---|---|---|
| 3,357,491 | A | 12/1967 | Jones et al. | |
| 3,444,928 | A | 5/1969 | Pitts | |
| 4,132,243 | A | 1/1979 | Kuus | |
| 4,246,967 | A | 1/1981 | Harris | |
| 4,427,065 | A | 1/1984 | Watson | |
| 4,491,177 | A | 1/1985 | Baugh | |
| 4,577,614 | A | 3/1986 | Schoeffler | |
| 4,624,312 | A | 11/1986 | McMullin | |
| 4,782,894 | A | 11/1988 | LaFleur | |
| 4,809,776 | A | 3/1989 | Bradley | |
| RE33,150 | E | 1/1990 | Boyd | |
| 4,890,357 | A | 1/1990 | Pinto et al. | |
| 4,893,676 | A | 1/1990 | Hill | |
| 4,934,452 | A | 6/1990 | Bradley | |
| 5,004,048 | A | 4/1991 | Bode | |
| 5,095,988 | A | 3/1992 | Bode | |
| 5,219,244 | A | 6/1993 | Skeels | |
| 5,236,035 | A | 8/1993 | Brisco et al. | |
| 5,343,968 | A | 9/1994 | Glowka | |
| 5,544,705 | A | 8/1996 | Jones et al. | |
| 5,722,491 | A | 3/1998 | Sullaway et al. | |
| 5,762,139 | A | 6/1998 | Sullaway et al. | |
| 5,787,979 | A | 8/1998 | Giroux et al. | |
| 5,829,523 | A | 11/1998 | North | |
| 5,884,656 | A | 3/1999 | Smith | |
| 5,890,537 | A | 4/1999 | Lavaure et al. | |
| 5,950,725 | A * | 9/1999 | Rondeau et al. | 166/70 |
| 5,960,881 | A | 10/1999 | Allamon et al. | |
| 6,009,944 | A | 1/2000 | Gudmestad | |
| 6,056,053 | A | 5/2000 | Giroux et al. | |
| 6,082,451 | A | 7/2000 | Giroux et al. | |
| 6,206,095 | B1 | 3/2001 | Baugh | |
| 6,237,686 | B1 | 5/2001 | Ryll et al. | |
| 6,244,350 | B1 | 6/2001 | Gudmestad et al. | |
| 6,279,654 | B1 | 8/2001 | Mosing | |
| 6,302,140 | B1 | 10/2001 | Brisco | |
| 6,360,769 | B1 | 3/2002 | Brisco | |
| 6,419,015 | B1 | 7/2002 | Budde et al. | |
| 6,491,103 | B2 | 12/2002 | Allamon et al. | |
| 6,517,125 | B2 | 2/2003 | Brisco | |
| 6,520,257 | B2 | 2/2003 | Allamon | |
| 6,527,057 | B2 | 3/2003 | Fraser, III et al. | |
| 6,571,880 | B1 | 6/2003 | Butterfield, Jr. et al. | |
| 6,575,238 | B1 | 6/2003 | Yokley | |
| 6,597,175 | B1 | 7/2003 | Brisco | |
| 6,672,384 | B2 | 1/2004 | Pedersen et al. | |
| 6,755,249 | B2 | 6/2004 | Robison et al. | |
| 6,776,228 | B2 | 8/2004 | Pedersen et al. | |
| 6,799,638 | B2 | 10/2004 | Butterfield, Jr. | |
| 6,802,372 | B2 | 10/2004 | Budde | |
| 7,040,401 | B1 | 5/2006 | McCannon | |
| 7,055,611 | B2 | 6/2006 | Pedersen et al. | |
| 7,093,664 | B2 | 8/2006 | Todd et al. | |
| 7,143,831 | B2 | 12/2006 | Budde | |
| 7,168,494 | B2 | 1/2007 | Starr et al. | |
| 7,172,038 | B2 | 2/2007 | Terry et al. | |
| 7,182,135 | B2 | 2/2007 | Szarka | |
| 7,249,632 | B2 | 7/2007 | Robichaux et al. | |
| 7,252,152 | B2 | 8/2007 | LoGiudice et al. | |
| 7,255,162 | B2 | 8/2007 | Stevens et al. | |
| 7,281,582 | B2 | 10/2007 | Robichaux et al. | |
| 7,281,589 | B2 | 10/2007 | Robichaux et al. | |
| 7,296,628 | B2 | 11/2007 | Robichaux et al. | |
| 7,353,879 | B2 | 4/2008 | Todd et al. | |
| 7,387,162 | B2 | 6/2008 | Mooney, Jr. et al. | |
| 7,503,398 | B2 | 3/2009 | LoGiudice et al. | |
| 7,537,052 | B2 | 5/2009 | Robichaux et al. | |
| 7,571,773 | B1 | 8/2009 | West et al. | |
| 7,607,481 | B2 | 10/2009 | Barbee | |
| 7,841,410 | B2 | 11/2010 | Barbee | |
| 7,878,237 | B2 | 2/2011 | Angman | |
| 8,069,922 | B2 | 12/2011 | Giem | |
| 2004/0020641 | A1 | 2/2004 | Budde | |
| 2004/0231836 | A1 | 11/2004 | Budde | |
| 2005/0016730 | A1 * | 1/2005 | McMechan et al. | 166/305.1 |
| 2005/0205264 | A1 | 9/2005 | Starr et al. | |
| 2005/0205265 | A1 | 9/2005 | Todd et al. | |
| 2005/0205266 | A1 | 9/2005 | Todd et al. | |
| 2006/0027360 | A1 | 2/2006 | Basso | |
| 2007/0068679 | A1 | 3/2007 | Robichaux et al. | |
| 2007/0158078 | A1 | 7/2007 | Boyd | |
| 2008/0053660 | A1 | 3/2008 | Angman | |
| 2008/0060811 | A1 | 3/2008 | Bour et al. | |
| 2008/0060820 | A1 | 3/2008 | Bour et al. | |
| 2008/0296012 | A1 | 12/2008 | Peer et al. | |
| 2010/0084145 | A1 | 4/2010 | Giem et al. | |

FOREIGN PATENT DOCUMENTS

| | | | |
|---|---|---|---|
| EP | 1903180 | A1 | 3/2008 |
| EP | 2009227 | A1 | 12/2008 |
| FR | 2663678 | | 12/1991 |
| WO | 9848143 | A1 | 10/1998 |
| WO | 2004011770 | A2 | 2/2004 |
| WO | 2005052311 | A1 | 6/2005 |
| WO | 2005108738 | A1 | 11/2005 |
| WO | 2007/016313 | | 2/2007 |

OTHER PUBLICATIONS

Piot B and Cuvillier P: "Primary Cementing Techniques," in Nelson EB and Guillot D (eds.): Well Cementing—2nd Edition, Houston: Schlumberger (2006): 459-500.

* cited by examiner

MULTIPLE ACTIVATION-DEVICE LAUNCHER FOR A CEMENTING HEAD

BACKGROUND OF THE INVENTION

The statements in this section merely provide background information related to the present disclosure and may not constitute prior art.

The invention is related in general to equipment for servicing subterranean wells. The invention relates to a deepsea cement head that is intended to drop a combination of darts, balls, bombs and canisters in order to activate downhole equipment, launch cementing plugs, deliver chemical products, or the like.

Existing tools implement a modular design with darts that are preloaded in baskets within the modules. The modules are connected to one another using clamps. The darts are held in place mechanically and released by removing the mechanical obstruction and redirecting the flow of the pumped fluid through the dart basket. The darts are then pumped through the tool by the fluid. The first dart to be launched is placed in the lowest module, with subsequent darts passing through the baskets vacated by the earlier darts.

Darts in prior designs are launched by blocking the bypass flow of the process fluid and forcing the fluid through the dart chamber. The dart forms an initial seal when placed into the basket. When fluid enters the dart chamber, pressure builds and breaks the seal, forcing the dart out of the basket, through the tool and into the main process-fluid stream.

Some prior art designs consist of modules similar to those described in U.S. Pat. Nos. 4,624,312 and 4,890,357. The darts are loaded from the topmost module, through the swivel if necessary, and pushed down to their respective baskets with a long rod. The modules have valves that are used to select between the dart and the bypass flow. The valve itself serves as the mechanical obstruction that prevents the dart from prematurely launching. When the valve is turned, it simultaneously opens a passage for the dart while closing the passage of the bypass flow.

It remains desirable to provide improvements in wellsite surface equipment in efficiency, flexibility, and reliability.

SUMMARY OF THE INVENTION

The present invention allows such improvement.

In a first aspect, the present invention relates to a multiple activation-device launching system for a cementing head, comprising a launcher body comprising at least one launching chamber and a device chamber, the launching chamber sized to receive one or more activation devices therein, the launching chamber in fluid communication with a power source for launching the activation device from the device chamber. The launching system may also comprise pressure-sensing devices, pressure-relief devices, volume-measurement devices, or combinations thereof, in hydraulic communication with one or more launching chambers, for monitoring the activation-device launching process.

In another aspect, the present invention aims at a method for deploying one or more activation devices into a process-fluid system, utilizing an angled launching system for a cementing head. The launching system comprises a launcher body comprising a primary valve and at least one launching chamber and a device chamber, the launching chamber equipped with a secondary valve and sized to receive one or more activation devices therein, the launching chamber in fluid communication with a power source for launching one or more activation devices into the device chamber. The method may also comprise one or both of the following operations during the launch of one or more activation devices: (i) monitoring the fluid pressure inside the launching chamber and (ii) measuring the process-fluid volume displaced into the launching chambers. Data acquired during these operations allow the operator to confirm successful activation-device deployment.

In a further aspect, the present invention pertains to a method for deploying one or more activation devices into a process-fluid system, utilizing an angled launching system for a cementing head. The launching system comprises a launcher body comprising at least one launching chamber and a device chamber, the launching chamber sized to receive one or more activation devices therein, the launching chamber in fluid communication with an external power source for launching one or more activation devices into the device chamber. The method may also comprise one or both of the following operations during the launch of one or more activation devices: (i) monitoring the fluid pressure inside the launching chamber and (ii) measuring the fluid volume displaced into the launching chambers from the external power source. Data acquired during these operations allow the operator to confirm successful activation-device deployment.

An embodiment of the invention comprises a single activation-device launcher module that contains multiple launching chambers arranged at an angle relative to the main axis of the tool. The activation devices may be darts, balls, bombs or canisters. The devices are loaded into their respective chambers directly or in a cartridge, but directly from the open air rather than through the length of the tool. A variety of methods can be used to launch the activation devices. The activation devices may also contain chemical substances that, upon exiting the launching chamber, are released into the well.

The advantages of the general implementation of the embodiment is that more activation devices may be fit into a shorter length tool, simplifying the loading process, and making the baskets more accessible for maintenance purposes. This allows easy maintenance of the tool on the rig, while the system from the art can only be serviced at the district.

In another embodiment of the invention, the system may comprise any number of launching chambers (at least one, but preferably two, three, four or more), each with an axis at an angle relative to the main axis of the tool. The chamber(s) may be positioned at the same level, or a different level (e.g. in spiral, or stages). When the activation devices are forced out of the chamber(s), they enter the main body of the tool in the correct orientation and are swept away by the pumped fluid (hereafter called process fluid) to serve their intended purpose. The exact number of chambers is not essential; indeed, multiple unique launching methods that will work independently from the arrangement of the launching chambers are contemplated.

In another embodiment, the activation devices are launched with process-fluid power as the motive power. Each launching chamber is preferably linked to the main flow of process fluid using a small pipe, hose, or integral manifold. A valve (primary valve) blocks the main flow on command, diverting the fluid into the launching chambers. Each launching chamber would comprise a valve (secondary valve) that alternately allows or blocks the flow of fluid into the corresponding launching chamber. All valves may be manually or remotely actuated. In a launch procedure, all secondary valves are initially closed, the primary valve is initially open. To launch an activation device, the operator opens the secondary valve corresponding to the activation device's chamber and then closes the primary valve. Once the activation device is successfully ejected from the launching chamber, the primary valve is reopened and the launch procedure is repeated for launching additional activation devices.

In another embodiment, external fluid power is used to launch the activation devices from their chambers. The external fluid power employed to force the activation device from its chamber may comprise water or fluid connected directly behind the activation device; a hydraulic cylinder with a rod that forces the dart out of its chamber, a hydraulic piston without a rod that seals within the launching chamber (activation device on one side, external fluid on the other), a bladder behind the activation device that fills from an external fluid source pushing the activation device out of the chamber, or a similar type of fluid power as will be appreciated by those skilled in the art.

In a preferred embodiment, external fluid power is used to launch the activation devices from their chambers. The external fluid power employed to force the activation device from its chamber may comprise water or fluid connected directly behind the activation device; a hydraulic cylinder with a rod that forces the dart out of its chamber, a hydraulic piston without a rod that seals within the launching chamber (activation device on one side, external fluid on the other), a bladder behind the activation device that fills from an external fluid source pushing the activation device out of the chamber, or a similar type of fluid power as will be appreciated by those skilled in the art. This preferred embodiment further comprises operations by which the progress of the activation-device launch process may be monitored. The operations comprise (i) monitoring the fluid pressure inside a launching chamber with one or more pressure sensors in hydraulic communication with the launching chamber; (ii) measuring the process-fluid volume displaced into the launching chamber; or both. Data acquired during these operations allow the operator to confirm successful activation-device deployment.

It will be appreciated by those skilled in the art that monitoring fluid pressure and fluid volume during activation-device deployment may be a useful practice with other similar activation-device launching systems that employ a fluid driven piston, bladder or other barrier device.

Although the disclosed launching system is mainly being presented in the context of well cementing, it will be appreciated that the process-fluid stream could comprise other well fluids including, but not limited to, drilling fluids, cement slurries, spacer fluids, chemical washes, acidizing fluids, gravel-packing fluids and scale-removal fluids.

DETAILED DESCRIPTION

Figure 1:
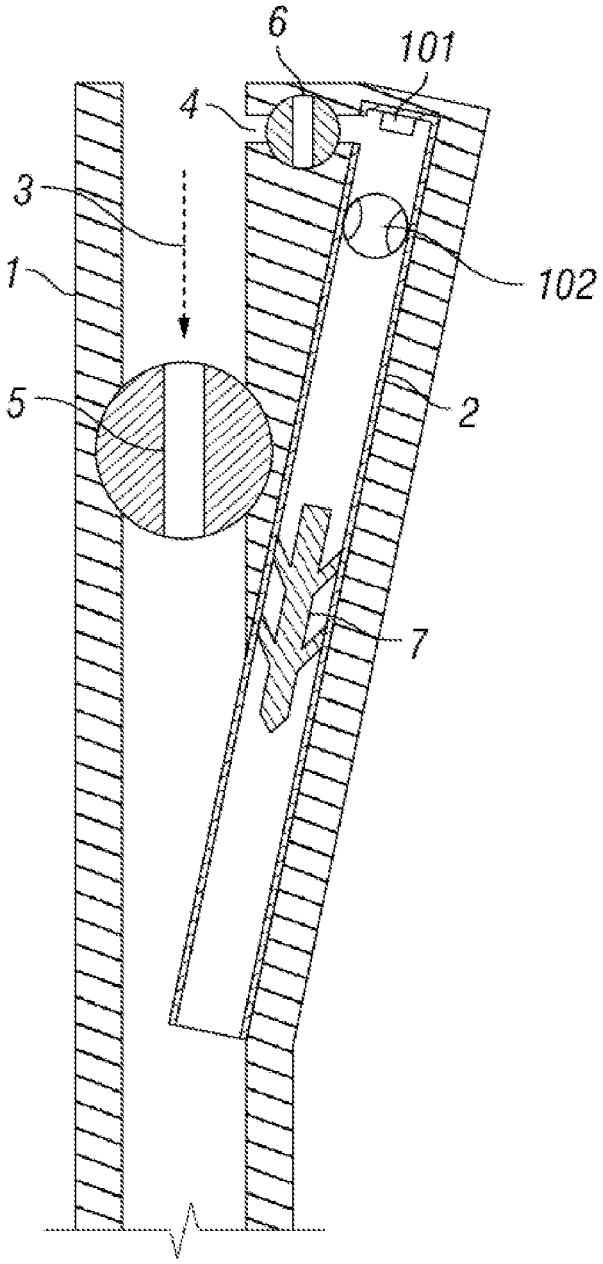
FIG. 1 is a conceptual view of a multiple activation-device launcher that employs valves to divert process-fluid flow to the launching chamber, forcing the activation device to exit the launching chamber.

According to one embodiment, the invention involves the diversion of process-fluid flow from the principal flow stream through the launcher body to one of the launching chambers. Referring to FIG. 1, the launcher module comprises two principal elements—the launcher body 1 which is the primary conduit through which the process fluid flows; and one or more launching chambers 2 containing one or more activation devices 7 and connected to the primary conduit. Activation devices are launched by closing the primary valve 5, which diverts process-fluid flow from the principal flow direction 3 into the conduit 4 connecting the main body to the launching chambers. Each launching chamber shall be equipped with a secondary valve 6 that allows or blocks process-fluid flow into the chamber. When the secondary valve is opened, and process fluid flows into the launching chamber, the activation device is pushed out of the launching chamber and into the principal process-fluid stream. The launcher module may further comprise a pressure sensor 101 and a flow-measurement device 102.

The primary valve preferably needs only to withstand enough differential pressure to force the activation device from the launching chamber. The primary valve may be a plug valve, a butterfly valve, a balloon-shaped bladder that inflates from the center to seal the main fluid passage, a doughnut-shaped bladder that inflates from the edges to seal the main fluid passage, a pressure-operated rubber component similar to those used in blowout preventers (BOPs) or inflatable packers or similar type valve, as will be appreciated by those skilled in the art.

The secondary valves may be any variety of on-off valves, but are preferably designed to be easily removed and cleaned after repeated exposure to particle-laden fluids such as cement slurry. The secondary valve may be a plug valve, a butterfly valve, a balloon-shaped bladder that inflates from the center to seal the main fluid passage, a doughnut-shaped bladder that inflates from the edges to seal the main fluid passage, a pressure-operated rubber component similar to those used in BOPs or inflatable packers, or similar type valve as will be appreciated by those skilled in the art.

Figure 2:
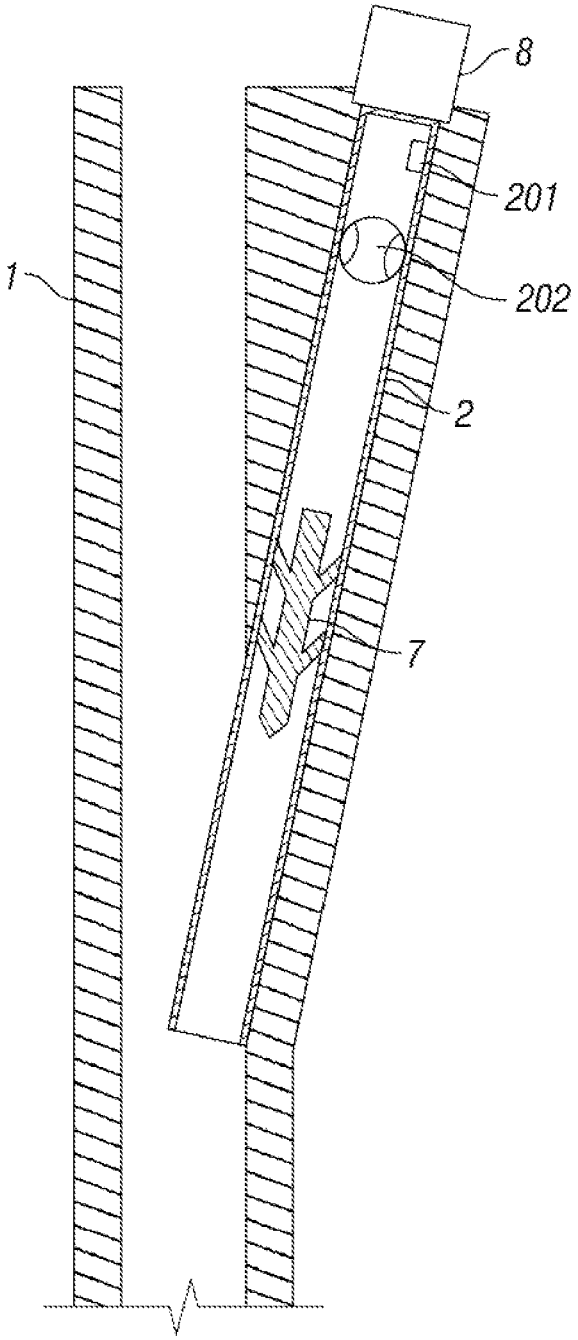
FIG. 2 is a conceptual view of a multiple activation-device launcher featuring an external power source that, when energized, forces the activation device to exit the launching chamber.

In another embodiment, shown in FIG. 2, an external device 8 forces one or more activation devices from the launching chamber 7. Several types of external power are envisioned. The launcher module may further comprise a pressure sensor 201 and a flow-measurement device 202.

Figure 3:
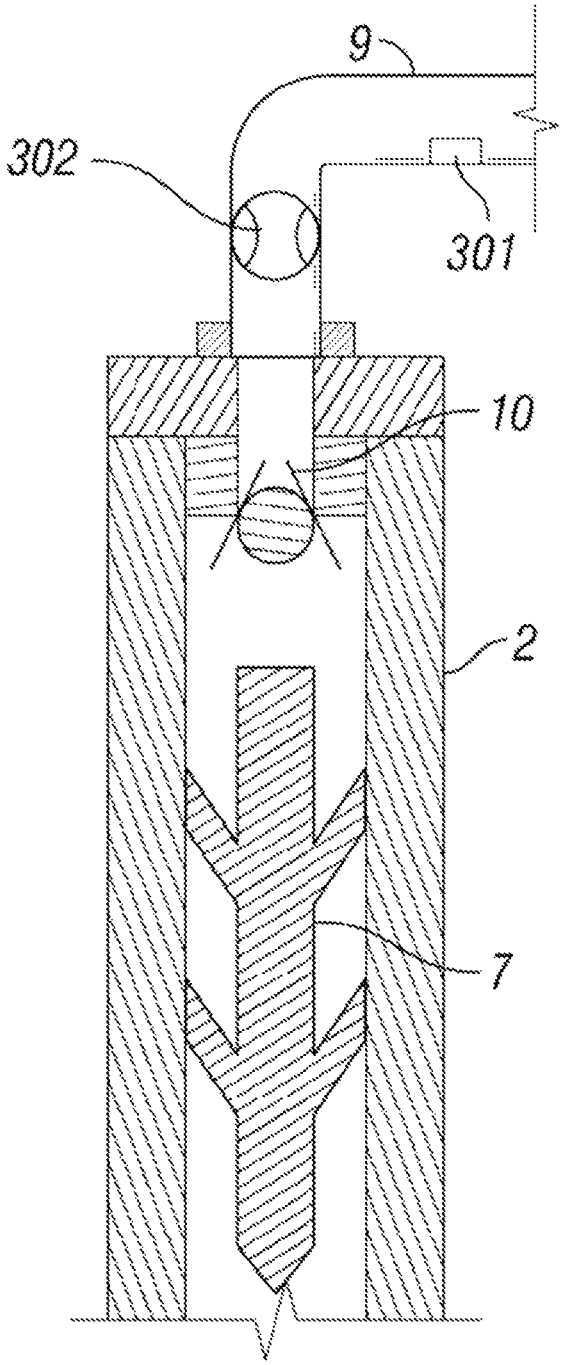
FIG. 3 is a conceptual view of a multiple activation-device launcher employing a fluid as the external power source.

As shown in FIG. 3, water or fluid connected directly behind the activation device may be used to expel the device from its chamber. The fluid is not directly connected to the main process fluid. A hydraulic line 9 conveys the fluid to the launching chamber 2. The operator opens a one-way valve 10, allowing the fluid to flow into the launching chamber and carry the activation device 7 out of the launching chamber and into the main process-fluid flow. The launcher module may further comprise a pressure sensor 301 and a flow-measurement device 302.

Figure 4:
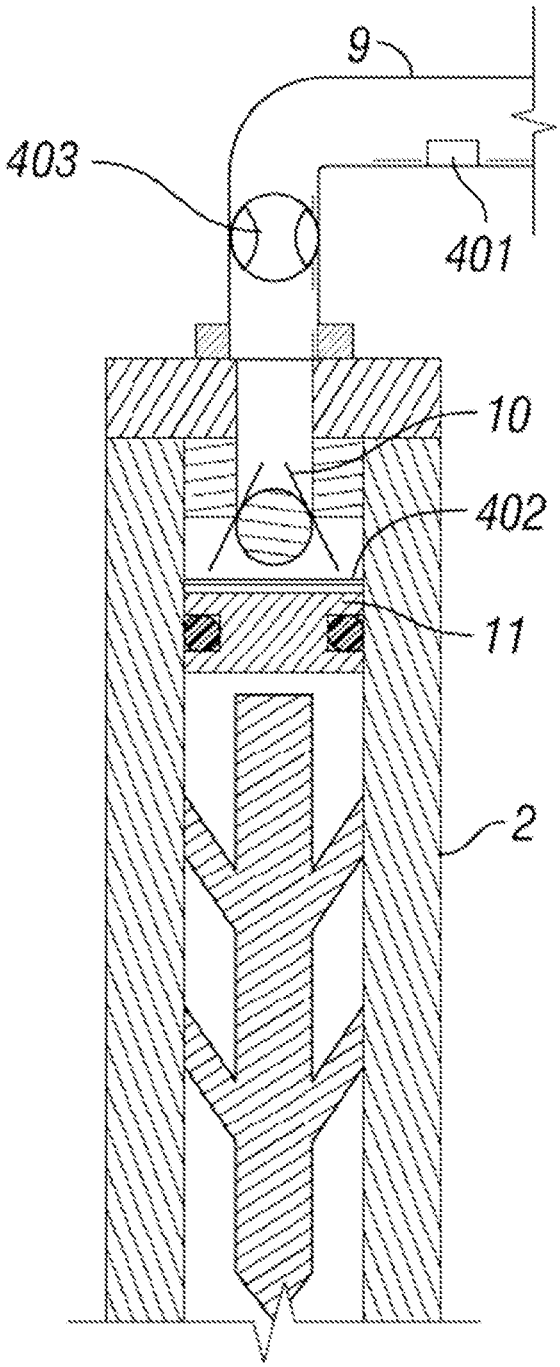
FIG. 4 is a conceptual view of a multiple activation-device launcher employing a piston as the external power source.

As shown in FIG. 4, a hydraulic line 9 conveys fluid to the launching chamber 2. After the operator actuates the one-way valve 10, the fluid enters the launching chamber and forces a piston 11 to move and push the activation device 7 out of the launching chamber and into the main process-fluid flow. The launcher module may further comprise a pressure sensor 401, a pressure-relief device 402 and a flow-measurement device 403.

Figure 5:
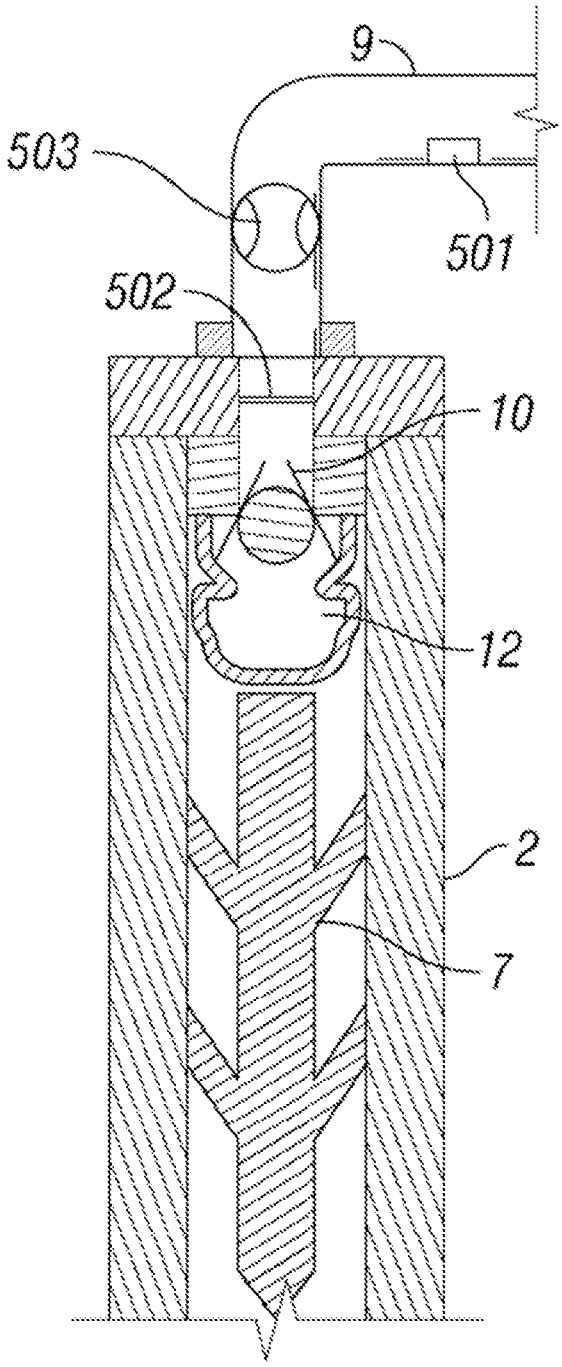
FIG. 5 is a conceptual view of a multiple activation-device launcher employing an inflatable bladder as the external power source.

As shown in FIG. 5, a hydraulic line 9 conveys fluid to the launching chamber 2. After the operator actuates the one-way valve 10, the fluid enters the launching chamber and inflates a bladder 12. As the bladder inflates, it pushes the activation device 7 out of the launching chamber and into the main process-fluid flow. The launcher module may further comprise a pressure sensor 501, a pressure-relief device 502 and a flow-measurement device 503.

Figure 6:
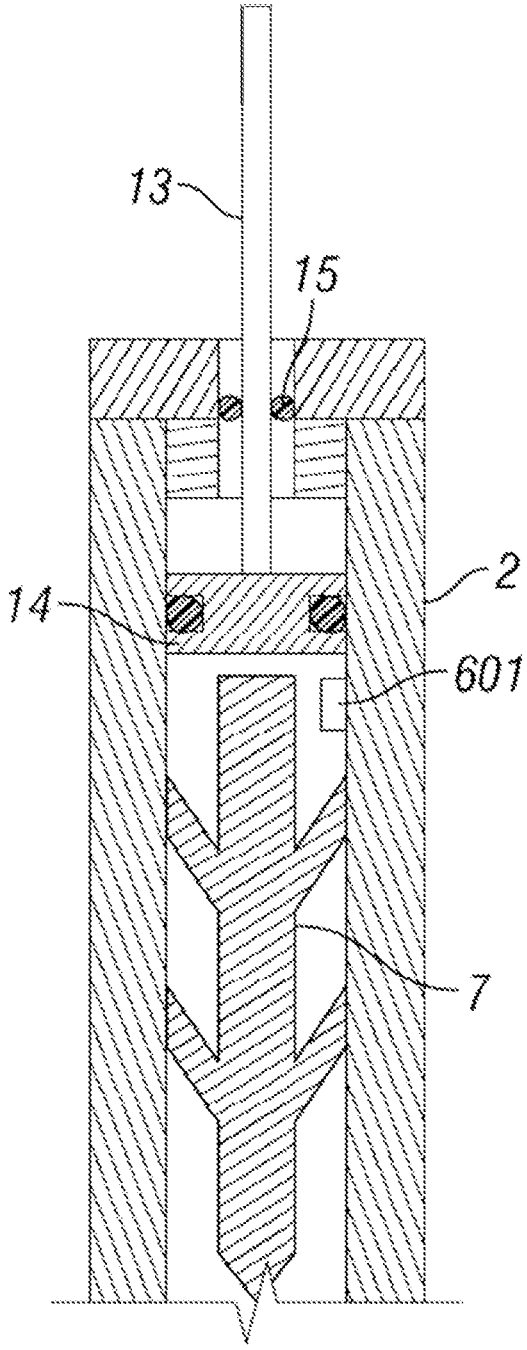
FIG. 6 is a conceptual view of a multiple activation-device launcher employing a rod and piston as the external power source.

As shown in FIG. 6, a hydraulic rod 13 extends out of the upper portion of the launching chamber 2, and is connected to a piston 14 inside the launching chamber. A hydraulic seal 15 isolates the inner and outer portions of the launching chamber. The operator pushes the rod further into the launching chamber, causing the piston to force the activation device 7 out of the launching chamber and into the main process-fluid flow. The launcher module may further comprise a pressure sensor 601.

Both embodiments described above may comprise equipment for monitoring the progress of the activation-device launching process. Such equipment may include pressure sensors, pressure-relief devices and volume-measurement devices, and combinations thereof that are in hydraulic communication with one or more launching chambers. Suitable pressure sensors include (but are not limited to) piezoresistive strain gauges, capacitive sensors, electromagnetic sensors, piezoelectric sensors and potentiometric sensors. Suitable pressure-relief devices may comprise (but not be limited to) rupture disks, pressure-relief valves, fusible-plug devices and combination rupture-disk/fusible-alloy devices. Suitable volume-measurement devices may comprise (but not be limited to) flowmeters, level sensors, visual sensors and pump-stroke counters.

In a preferred embodiment, shown in FIG. 2, an external device 8 forces one or more activation devices from the launching chamber 7. Several types of external power are envisioned.

As shown in FIG. 3, water or fluid connected directly behind the activation device may be used to expel the device from its chamber. The fluid is not directly connected to the main process fluid. A hydraulic line 9 conveys the fluid to the launching chamber 2. The operator opens a one-way valve 10, allowing the fluid to flow into the launching chamber and carry the activation device 7 out of the launching chamber and into the main process-fluid flow.

As shown in FIG. 4, a hydraulic line 9 conveys fluid to the launching chamber 2. After the operator actuates the one-way valve 10, the fluid enters the launching chamber and forces a piston 11 to move and push the activation device 7 out of the launching chamber and into the main process-fluid flow.

As shown in FIG. 5, a hydraulic line 9 conveys fluid to the launching chamber 2. After the operator actuates the one-way valve 10, the fluid enters the launching chamber and inflates a bladder 12. As the bladder inflates, it pushes the activation device 7 out of the launching chamber and into the main process-fluid flow.

As shown in FIG. 6, a hydraulic rod 13 extends out of the upper portion of the launching chamber 2, and is connected to a piston 14 inside the launching chamber. A hydraulic seal 15 isolates the inner and outer portions of the launching chamber. The operator pushes the rod further into the launching chamber, causing the piston to force the activation device 7 out of the launching chamber and into the main process-fluid flow.

The preferred embodiment further comprises equipment for monitoring the progress of the activation-device launching process. Such equipment may include pressure sensors, pressure-relief devices and volume-measurement devices, and combinations thereof that are in hydraulic communication with one or more launching chambers. Suitable pressure sensors include (but are not limited to) piezoresistive strain gauges, capacitive sensors, electromagnetic sensors, piezoelectric sensors and potentiometric sensors. Suitable pressure-relief devices may comprise (but not be limited to) rupture disks, pressure-relief valves, fusible-plug devices and combination rupture-disk/fusible-alloy devices. Suitable volume-measurement devices may comprise (but not be limited to) flowmeters, level sensors, visual sensors and pump-stroke counters. It will be appreciated by those skilled in the art that such pressure-measurement and volume-measurement equipment may be may be useful with other similar activation-device launching systems that employ a fluid driven piston, bladder or other barrier device.

Figure 7:
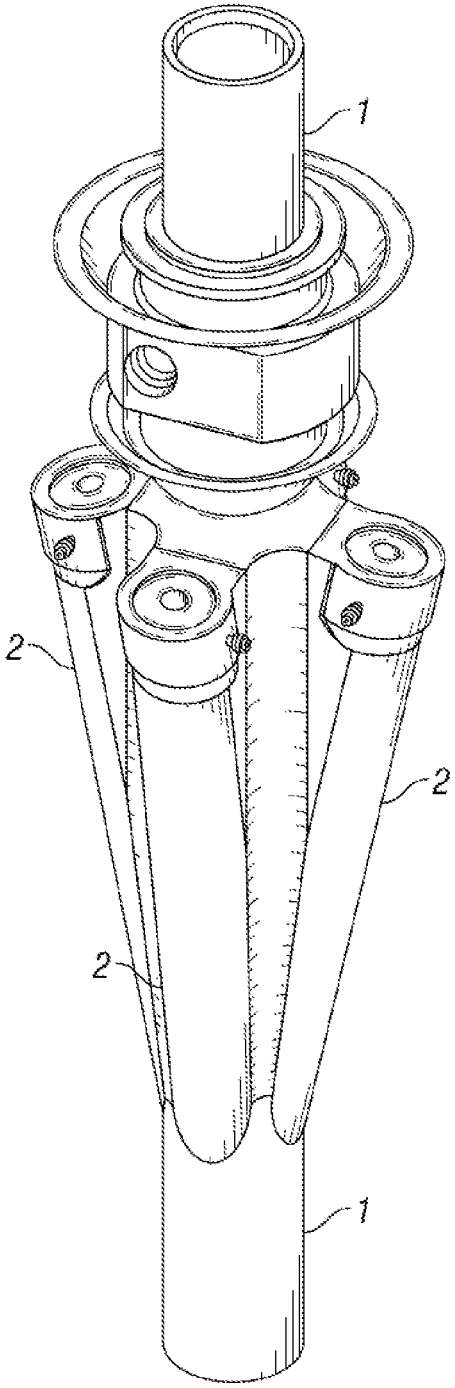
FIG. 7 is an external view of the invention featuring multiple launching chambers.

FIG. 7 is an external view of the present invention with multiple launching chambers.

The activation device depicted in the drawings is a dart; however, activation devices may also include balls, bombs and canisters.

The activation devices may be filled with a chemical substance that, upon release from the launching chamber, is dispensed from the activation device into the process fluid. The chemical release may occur at any time after the activation device is launched—from the moment of launching to any time thereafter. Delayed chemical release may be performed for a number of reasons including, but not limited to, avoiding fluid rheological problems that the chemical would cause if added during initial fluid mixing at surface, and triggering the initiation of chemical reactions in the fluid (e.g., cement-slurry setting and fracturing-fluid crosslinking) at strategic locations in the well.

The process fluid may comprise one or more fluids employed in well-service operations. Such fluids include, but are not limited to, drilling fluids, cement slurries, spacer fluids, chemical washes, acidizing fluids, gravel-packing fluids and scale-removal fluids.

The present invention also comprises a method of operating the multiple activation-device launcher depicted in FIG. 1 comprising inserting one or more activation devices 7 in at least one of the launching chambers 2, and closing the secondary valves 6 in each of the launching chambers. Process fluid is then pumped through the launcher body 1. When it is time to release an activation device 7, the primary valve 5 is closed and the secondary valve 6 is opened in the launching chamber of choice. This diverts process-fluid flow through the launching chamber 2, forcing the activation device 7 to exit into the launcher body 1. After the activation device 7 is launched, the secondary valve 6 is closed, the primary valve 5 is reopened to restore process-fluid flow through the launcher body 1, and the activation device 7 is carried to its destination. This process is then repeated until a sufficient number of activation devices have been deployed to complete the treatment. One or more activation devices may contain a chemical substance that is released to the process fluid after deployment into the process fluid.

The primary valve preferably needs only to withstand enough differential pressure to force the activation device from the launching chamber. The primary valve may be a plug valve, a butterfly valve, a balloon-shaped bladder that inflates from the center to seal the main fluid passage, a doughnut-shaped bladder that inflates from the edges to seal the main fluid passage, a pressure-operated rubber component similar to those used in BOPs or inflatable packers or similar type valve, as will be appreciated by those skilled in the art.

The secondary valves may be any variety of on-off valves, but are preferably designed to be easily removed and cleaned after repeated exposure to particle-laden fluids such as cement slurry. The secondary valve may be a plug valve, a butterfly valve, a balloon-shaped bladder that inflates from the center to seal the main fluid passage, a doughnut-shaped bladder that inflates from the edges to seal the main fluid passage, a pressure-operated rubber component similar to those used in BOPs or inflatable packers, or similar type valve as will be appreciated by those skilled in the art.

This method may include operations by which the progress of the activation-device launch process may be monitored. The operations comprise (i) monitoring the fluid pressure inside a launching chamber with one or more pressure sensors in hydraulic communication with the launching chamber; (ii) measuring the process-fluid volume displaced into the launching chamber; or both. Pressure monitoring may be performed by pressure sensors; however, In this particular method, pressure-relief devices are not employed owing to the lack of a piston, bladder or other barrier mechanism that drives the activation device out of the launching chamber. The activation device is launched by fluid flow only. Suitable pressure sensors include (but are not limited to) piezoresistive strain gauges, capacitive sensors, electromagnetic sensors, piezoelectric sensors and potentiometric sensors. Fluid-volume measurements may be performed by equipment that includes, but is not limited to, flowmeters, level sensors, visual sensors and pump-stroke counters. These monitoring operations may be performed in one or more launching chambers.

Figure 8:
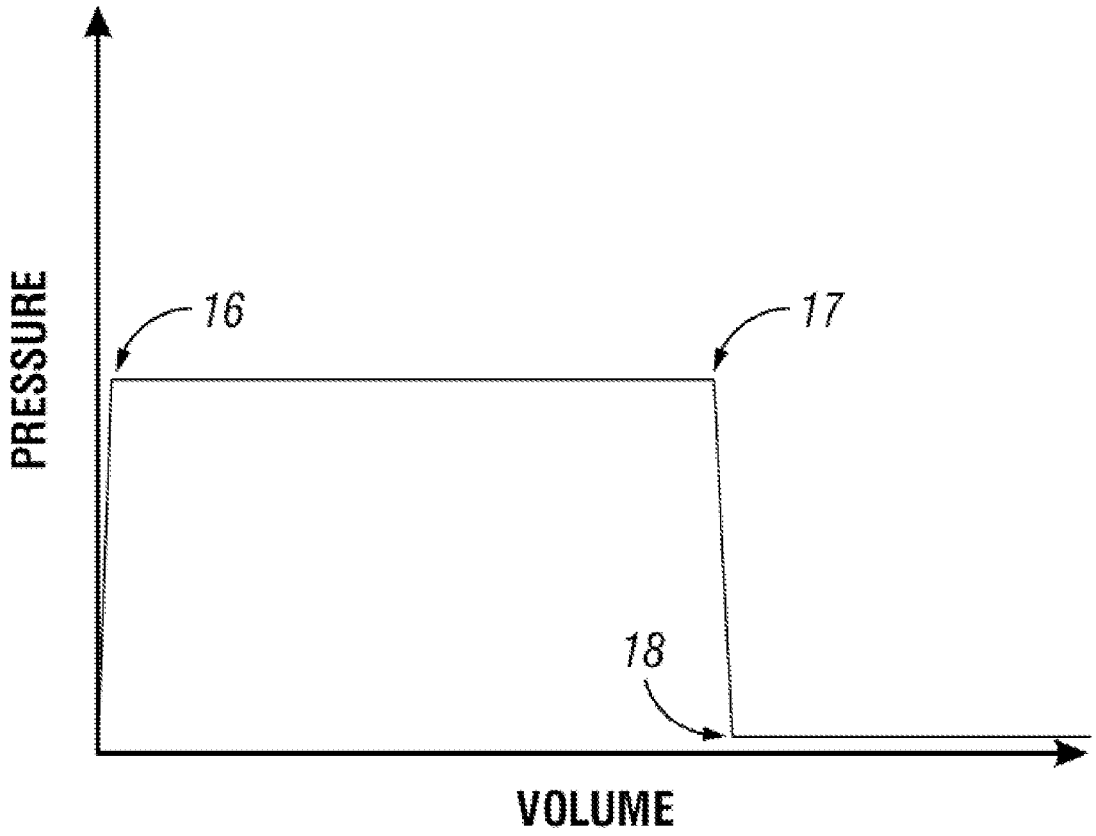
FIG. 8 is a plot illustrating the pressure/volume profile during an activation-device launch, wherein (i) the activation device is driven out of the launching chamber by fluid flow alone; or (ii) the launching chamber is not equipped with a pressure-relief device.

FIG. 8 is a plot of pressure/volume data that an operator would observe during a successful activation-device launch. The plot shows the fluid pressure versus the fluid volume pumped into the launching chamber. As process fluid enters the launching chamber, the fluid pressure attains a level 16 sufficient to initiate movement of the activation device. When the activation device leaves the launching chamber, the fluid pressure begins to drop 17, and falls to the level observed at the beginning of the launching procedure 18.

In a preferred embodiment, the present invention pertains to a method of operating the multiple activation-device launcher depicted in FIG. 2, comprising inserting one or more activation devices 7 in at least one of the launching chambers 2, and connecting the chambers to an external power source 8. Power sources include, but are not limited to, a fluid connected directly behind the activation device 7 (FIG. 3), a hydraulic cylinder 14 with a rod 13 (FIG. 6), a hydraulic piston 11 without a rod (FIG. 4), and an inflatable bladder 12 (FIG. 5). Process fluid is pumped through the launcher body 1. When it is time to release an activation device 7, the external power source 8 is activated, forcing the activation device 7 to exit into the launcher body 1. This process is repeated until a sufficient number of activation devices have been deployed to complete the treatment. One or more activation devices may contain a chemical substance that is released to the process fluid after deployment into the process fluid.

This preferred embodiment includes operations by which the progress of the activation-device launch process can be monitored. The operations comprise (i) monitoring the fluid pressure inside a launching chamber with one or more pressure sensors in hydraulic communication with the launching chamber; (ii) measuring the process-fluid volume displaced into the launching chamber; or both. Pressure monitoring may be performed by pressure sensors, pressure-relief devices, or both. Unlike the previous method, pressure-relief devices may be employed if the activation-device launching system includes a piston, bladder or other barrier mechanism that drives the activation device out of the launching chamber. Suitable pressure sensors include (but are not limited to) piezoresistive strain gauges, capacitive sensors, electromagnetic sensors, piezoelectric sensors and potentiometric sensors. The pressure-relief devices may comprise one of more members of the list comprising: rupture disks, pressure-relief valves, fusible-plug devices and combination rupture-disk/fusible-alloy devices. Fluid-volume measurements may be performed by equipment that includes, but is not limited to, flowmeters, level sensors, visual sensors and pump-stroke counters. These monitoring operations may be performed in one or more launching chambers.

Figure 9:
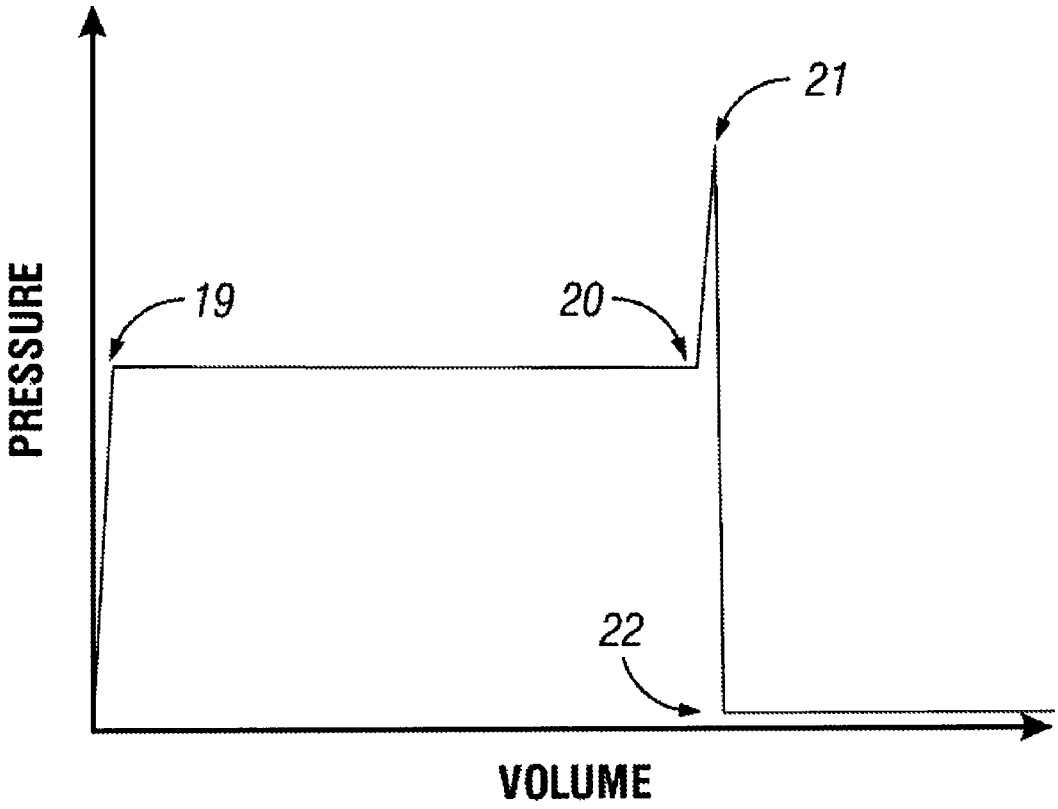
FIG. 9 is a plot illustrating the pressure/volume profile during an activation-device launch, wherein the launching chamber is equipped with a pressure-relief device.

FIG. 9 is a plot of pressure/volume data that an operator would observe during a successful activation-device launch from a chamber equipped with a pressure-relief device. In these cases, the launching chamber includes a piston, bladder or other barrier mechanism that drives the activation device out of the launching chamber. The plot shows the fluid pressure versus the fluid volume pumped into the launching chamber. As fluid from the external power source enters the launching chamber, the fluid pressure attains a level 19 sufficient to initiate movement of the activation device. When the activation device leaves the launching chamber, movement of the piston, bladder or other mechanism becomes restricted. For example, the piston reaches the end of the chamber and can no longer move, or the bladder becomes fully inflated and can no longer accept additional fluid. As a result, the fluid pressure begins to increase 20. The fluid pressure continues to increase until the pressure-relief device fails 21. After failure, the fluid pressure falls to the level observed at the beginning of the launching procedure 22.

It will be appreciated by those skilled in the art that such pressure-measurement and volume-measurement operations may be useful with other similar activation-device launching systems that employ a fluid driven piston, bladder or other barrier device.

The methods of operating the multiple activation-device launcher depicted in FIGS. 1 and 2 may further comprise activation devices containing a chemical substance that is released after the activation device exits the launching chamber. The activation device may begin dispensing the chemical substance immediately upon launching, or at any time thereafter.

In the methods of operating the multiple activation-device launcher depicted in FIGS. 1 and 2, the process fluid may comprise one or more fluids employed in well-service operations. Such fluids include, but are not limited to, drilling fluids, cement slurries, spacer fluids, chemical washes, acidizing fluids, gravel-packing fluids, scale-removal fluids. In addition, the activation devices may comprise darts, balls, bombs and canisters.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A multiple activation-device launching system for a cementing head, comprising:

(i) a launcher body comprising a central passage through which process fluid flows;

(ii) at least four launching chambers that are sized to receive one or more activation devices therein, the launching chambers being arranged at an angle relative to the axis of the launcher body and in fluid communication with a power source for launching the activation device from its chamber into the main process-fluid flow, wherein the power source is a device external to the launcher body and in fluid communication with the launching chamber; and (iii) one or more pressure sensors, or one or more pressure relief devices, or a combination thereof, wherein, during launching, the sensors or devices or both are in hydraulic communication with the process fluid entering one or more of the launching chambers.

2. The system of claim 1, wherein the activation devices comprise darts, balls, bombs or canisters, or combinations thereof.

3. The system of claim 1 wherein the external power source comprises one or more members selected from the group consisting of a fluid connected directly behind the activation device, a hydraulic cylinder with a rod that forces one or more activation devices out of the launching chamber, a hydraulic piston without a rod that seals within the activation device chamber, and a bladder behind the activation device that fills from an external fluid source.

4. The system of claim 1, wherein the pressure sensors comprise one or more members selected from the group consisting of piezoresistive strain gauges, capacitive sensors, electromagnetic sensors, piezoelectric sensors and potentiometric sensors.

5. The system of claim 1, wherein the pressure-relief devices comprise one of more members selected from the group consisting of rupture disks, pressure-relief valves, fusible-plug devices and combination rupture-disk/fusible-alloy devices.

6. A method for deploying one or more activation devices into a process-fluid, comprising:

providing a multiple activation-device launching system for a cementing head, the launching system comprising:

(i) a launcher body that comprises a central passage through which a process fluid flows;

(ii) a primary valve and at least four launching chambers equipped with a secondary valve and sized to receive the one or more activation devices therein, the launching chambers in fluid communication with a power source for launching one or more activation devices into a main process-fluid flow, wherein the power source is a device external to the launcher body and in fluid communication with the launching chamber; and (iii) one or more pressure sensors, or one or more pressure relief devices, or a combination thereof, wherein, during launching, the sensors or devices or both are in hydraulic communication with the process fluid entering one or more of the launching chambers.

7. The method of claim 6, further comprising performing one or both of the following operations during the launch of one or more activation device, from a launching chamber:

monitoring the fluid pressure inside the launching chamber during the launch of one or more activation devices with the one or more pressure sensors, or the one or more pressure relief devices, or a combination thereof.

8. The method of claim 7, wherein the pressure sensors are selected from the group consisting of piezoresistive strain gauges, capacitive sensors, electromagnetic sensors, piezoelectric sensors and potentiometric sensors.

9. The method of claim 6, wherein the activation-devices comprise darts, balls, bombs or canisters or combinations thereof.

10. A method for deploying one or more activation devices into a process-fluid stream, comprising:

providing a multiple activation-device launching system for a cementing head, the launching system comprising:

(i) a launcher body that comprises a central passage through which a process fluid flows;

(ii) a primary valve and at least four launching chambers, the launching chambers equipped with a secondary valve and sized to receive one or more activation devices therein, the launching chambers in fluid communication with a power source for launching the one or more activation devices into a main process-fluid flow, the power source being external and independent of the process fluid; and (iii) one or more pressure sensors, or one or more pressure relief devices, or a combination thereof, wherein, during launching, the sensors or devices or both are in hydraulic communication with the process fluid entering one or more of the launching chambers.

11. The method of claim 10, wherein the external power source comprises one or more members selected from the group consisting of a fluid connected directly behind the activation device, a hydraulic cylinder with a rod that forces one or more activation devices out of the launching chamber, a hydraulic piston without a rod that seals within the activation device chamber, and a bladder behind the activation device that fills from an external fluid source.

12. The method of claim 10, further comprising monitoring the fluid pressure inside the launching chamber during the launch of one or more activation devices with the one or more pressure sensors, or the one or more pressure relief devices, or a combination thereof.

13. The method of claim 12, wherein the pressure sensors are selected from the group consisting of piezoresistive strain gauges, capacitive sensors, electromagnetic sensors, piezoelectric sensors and potentiometric sensors.

14. The method of claim 12, wherein the pressure-relief devices are employed to provide additional fluid-pressure information, the pressure-relief devices comprising one of more members of the group consisting of rupture disks, pressure-relief valves, fusible-plug devices and combination rupture-disk/fusible-alloy devices.

15. The method of claim 10, wherein the activation-devices comprise darts, balls, bombs or canisters or combinations thereof.

16. The method of claim 10, wherein the process fluid comprises one or more fluids selected from the group consisting of drilling fluids, cement slurries, spacer fluids, chemical washes, acidizing fluids, gravel-packing fluids and scale-removal fluids.

* * * * *